US009622514B1

(12) United States Patent
Bauer

(10) Patent No.: US 9,622,514 B1
(45) Date of Patent: Apr. 18, 2017

(54) UNDERGARMENT FOR PREVENTION OF SKIN IRRITATION FROM OVERHANGING ABDOMEN

(71) Applicant: Carol A Bauer, El Cerrito, CA (US)

(72) Inventor: Carol A Bauer, El Cerrito, CA (US)

( * ) Notice: Subject to any disclaimer, the term of this patent is extended or adjusted under 35 U.S.C. 154(b) by 0 days.

(21) Appl. No.: 15/087,618

(22) Filed: Mar. 31, 2016

(51) Int. Cl.
*A41B 9/00* (2006.01)
*A41B 9/14* (2006.01)
*A41B 17/00* (2006.01)

(52) U.S. Cl.
CPC ..... *A41B 9/001* (2013.01); *A41B 9/14* (2013.01); *A41B 17/00* (2013.01)

(58) Field of Classification Search
CPC .... A41C 1/00; A41C 1/10; A41D 7/00; A41D 1/20; A41D 1/10; A41D 13/1236; A41B 9/04; A41B 9/02
USPC ..... 2/114, 67, 400–403, 406, 227, 228, 236, 2/237; 450/155, 94–100; 128/98.1, 99.1, 128/100.1, 101.1
See application file for complete search history.

(56) References Cited

U.S. PATENT DOCUMENTS 3,454,003 A * 7/1969 Sailhen dit Kleber-Sailhen ..... A41B 9/02 128/96.1
4,571,743 A * 2/1986 Wagoner ..... A41D 13/1236 2/114
RE33,406 E * 10/1990 Wior ..... A41D 7/00 2/67
5,217,403 A * 6/1993 Nobbs ..... A41C 1/10 2/237
5,983,404 A * 11/1999 Jackson ..... A41D 1/20 2/400
2009/0081926 A1* 3/2009 Gros ..... A41C 1/10 450/155
2011/0230121 A1* 9/2011 Fong ..... A41B 9/04 450/155

* cited by examiner

*Primary Examiner* — Gloria Hale
(74) *Attorney, Agent, or Firm* — Patent Ingenius LLC; Scott Evan Gilbert

(57) ABSTRACT

A novel undergarment is disclosed that solves the problem presented to obese persons having an overhanging or sagging abdomen creating skin irritation and rashes to portions of the lower torso by friction and moisture retention. The innovative undergarment is a panty having an internal partition that separates the interior of the panty into posterior and anterior compartments. When worn, the anterior compartment may form a pouch into which the overhanging mass of the abdomen may be received. The partition is naturally disposed between the skin of the overhanging belly and that of the lower torso regions, preventing skin-to-skin contact and ensuing skin problems. The partition may be stitched along the seams of the undergarment. In some embodiments, the partition may be anchored to the rear of the undergarment for added support.

9 Claims, 9 Drawing Sheets

Fig. 1b

UNDERGARMENT FOR PREVENTION OF SKIN IRRITATION FROM OVERHANGING ABDOMEN

FIELD OF THE INNOVATION

This innovation relates to supportive undergarments for obese wearers who have an overhanging abdomen, or of wearers who have had liposuction surgery, where loose abdominal skin may hang over the lower abdomen and groin regions and cause irritation and other skin complications.

BACKGROUND

Many obese men and women are plagued by an overhanging or pendulous abdomen, where the abdomen or belly lies over the lower abdomen and groin regions of the body, and is in many cases in intimate contact with these lower regions. The overhang of the abdomen or belly is caused by excess fatty tissue in the greater omentum that spills over the waist, a condition common in obese persons. The underlying skin of the overhanging abdomen is touching the skin of the lower abdomen and even the groin areas, which are overlaid, causing irritations and rashes to develop by friction and moisture retention. The same is true for persons having had liposuction surgery, or rapid weight loss, where they are left with pendulous abdominal skin that creates the same problems. While these are afflictions are more commonly suffered by growing numbers of obese persons, no comfortable solution has been formulated to date.

SUMMARY OF THE INNOVATION

The innovation disclosed herein is an undergarment in the form of underpants or panty, of which embodiments may be set forth for both men and women, which solves the problem of irritation and rashes caused by overhanging pendulous abdomen mass as discussed in the preceding section. The innovative undergarment provides an interior fabric panel as a means of a separation partition between the underlying skin of the abdominal (belly) overhang and the skin of the underlying lower abdominal and thigh regions, skin-to-skin contact between the belly overhang and the underlying lower abdominal skin, as well as skin in the groin region, is eliminated. In instances of the embodiments described herein, the fabric panel is disposed on the inside of the undergarment, dividing the interior of the undergarment into an anterior (front) compartment and a posterior (rear) compartment. The anterior compartment receives the overhanging abdominal mass when the innovative undergarment is worn. It is formed substantially forward of the leg openings, and may comprise an elastic fabric. In alternative embodiments, an elastic band may be disposed along the top hem of the partition. The partition may be form-fitting to the abdomen (under the overhanging belly), to form a snug but comfortable fit around the torso. The elastic band commonly disposed along the top of the undergarment may stretch around the front-facing (outer) side of the belly overhang, covering the front of the overhang. The anterior compartment may form a pouch for the belly overhang. The composition of the partition may comprise fabrics such as wicking fabrics, cotton, polyesters, nylon, bamboo, hemp and microfabric, either having tight weaves or woven into gauze and mesh materials. Partition materials may comprise single-layer or multi-layer fabrics, including quilted materials.

In other embodiments, the partition panel is anchored to the rear regions of the innovative undergarment, the anchor points being disposed behind the median seam, along buttocks region of the undergarment in the posterior compartment. The anchor points may be disposed along the top hem of the undergarment in the posterior buttocks region. In other embodiments, straps or fabric segments may extend from the posterior anchor points to wrap around the lower torso from the posterior to the anterior, or loins. Said straps may connect to an abbreviated partition, where the partition's lateral extent is shortened in comparison to the other embodiments. The panel may be sewn into the hem seams of the fabric along the leg openings in the anterior portion of the undergarment, and form a flap of fabric that is supported by the straps extending to the anchor points in the anterior portion of the panty undergarment. The wearer may slip on the panties on while the partition inserts between the abdomen and the overhanging belly. The straps, which may be comprised of an elastic fabric, pull the flap towards the abdomen of the wearer. The outer fabric of the anterior panel of the undergarment may pulled over the overhanging mass, where an elastic upper hem may pull the fabric of the anterior panel snug around the belly overhang. In the embodiments where the panel is directly anchored to the posterior fabric along the buttocks, the panel may be stitched to the seam around the leg openings. When wearing the innovative undergarment, the wearer

DETAILED DESCRIPTION

Figure 1A:
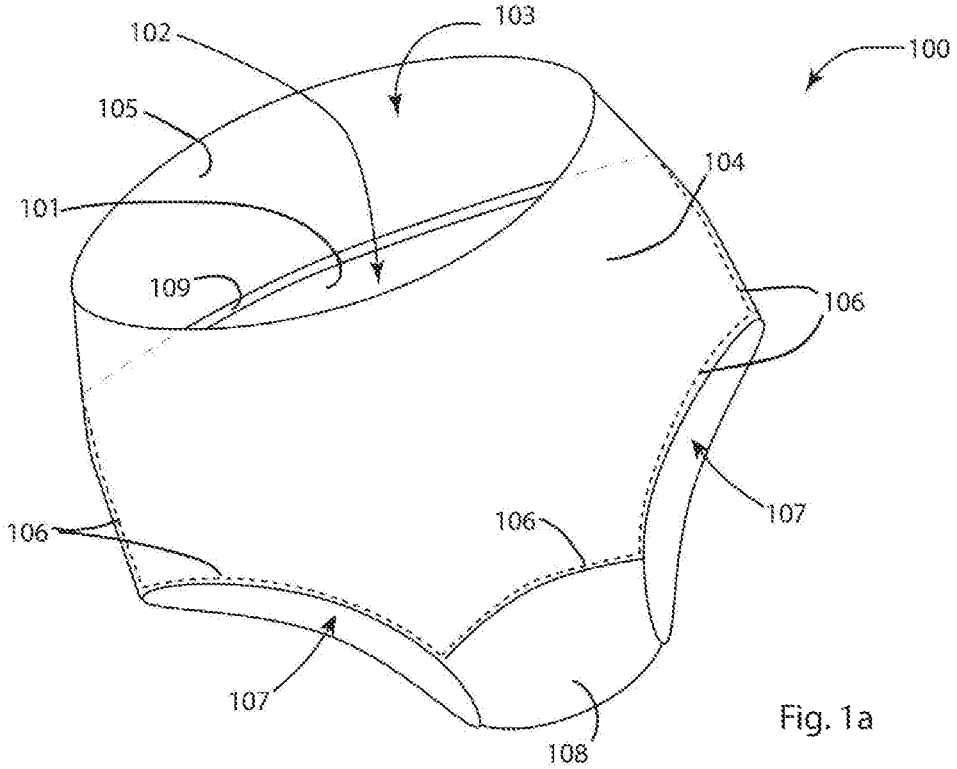
FIG. 1*a*. Perspective view of a first embodiment of the innovative undergarment.

FIG. 1 shows a first embodiment of the innovative undergarment 100. Fabric partition 101 divides the interior of innovative undergarment 100 into an anterior compartment 102 and a posterior compartment 103. Anterior portion 102 serves the function of encasing at least a portion of the overhanging belly of the wearer, where partition 101 serves to form a separation wall or membrane preventing contact between the underlying skin of the belly overhang and the skin of the lower abdomen, which is otherwise in intimate contact with the underlying skin of the belly overhang. Anterior compartment 102 is bounded by fabric partition 101 and front panel fabric 104, whereas posterior compartment is bounded by fabric partition 101 and rear panel fabric 105. Stitching 106 may be used as one means to attach fabric partition 101 to the fabric of undergarment 100, as shown in FIG. 1*a*. Partition 101 may be attached along the hem lines of leg holes 107, extending across crotch panel 108 to close the bottom of anterior compartment 102. In some embodiments, elastic band 109 may be integrated along the top hem of fabric partition 101 to provide partition 101 with a form-fitting property, whereby partition 101 may be urged to cling to the lower abdomen by elastic band 109. In alternative embodiments, partition 101 may comprise an elastic, or stretchable fabric, such as, but by no means limited to, Lycra and spandex. Connection of both front panels and partition to the crotch can be in the front curve of crotch (same as front attachments of other commercial panties). Front panel 104 may be slipped over the belly overhang and cling to it by in-manufactured elasticity in the fabric or stretch band along the top hem.

Figure 1B:
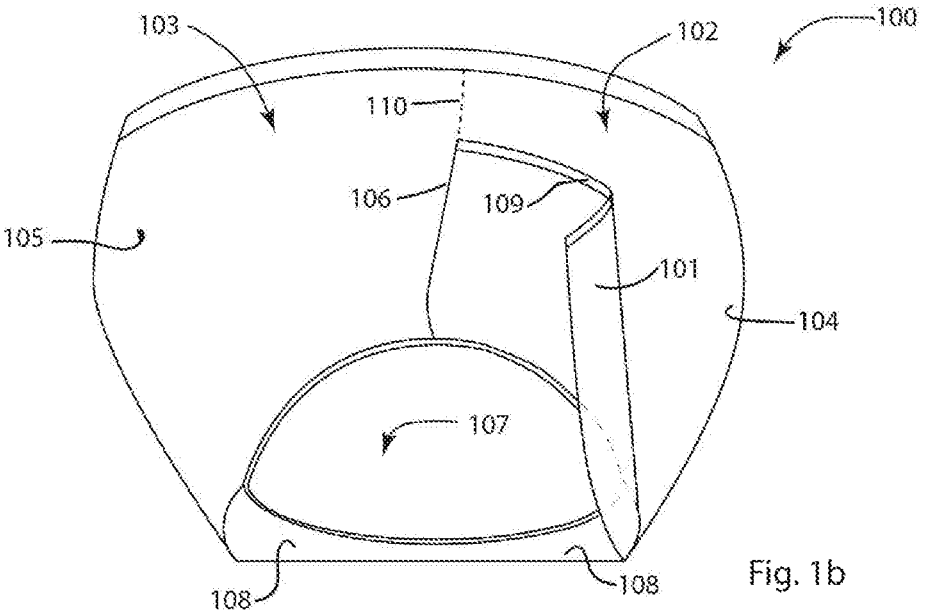
FIG. 1*b*. Side sectional view of a first embodiment of the innovative undergarment.

FIG. 1*b* shows a sectional side view of innovative undergarment 100, revealing more clearly the anterior and posterior compartments 102 and 103, respectively, separated by partition 101, which is shown pulled away from front panel 104. In this embodiment, partition 101 is stitched to the fabric of undergarment 100 along the entirety of its length at the terminator between front panel 104 and rear panel 105, shown by central seam 110, although it is recognized that some undergarment designs are seamless. Partition 101 may be stitched to the central seam of the undergarment, or along any vertical or diagonal line separating panels 104 and 105, and in the present embodiment, terminating at the hem line of leg opening 108. As will be disclosed below, other embodiments of the innovative undergarment are not limited to this configuration. Also evident in FIG. 1*b* is the convergence of partition 101 and front panel 104 at the bottom of undergarment 100, forming a V-shaped profile converging to a single point at the bottom of anterior compartment 102.

Figure 2A:
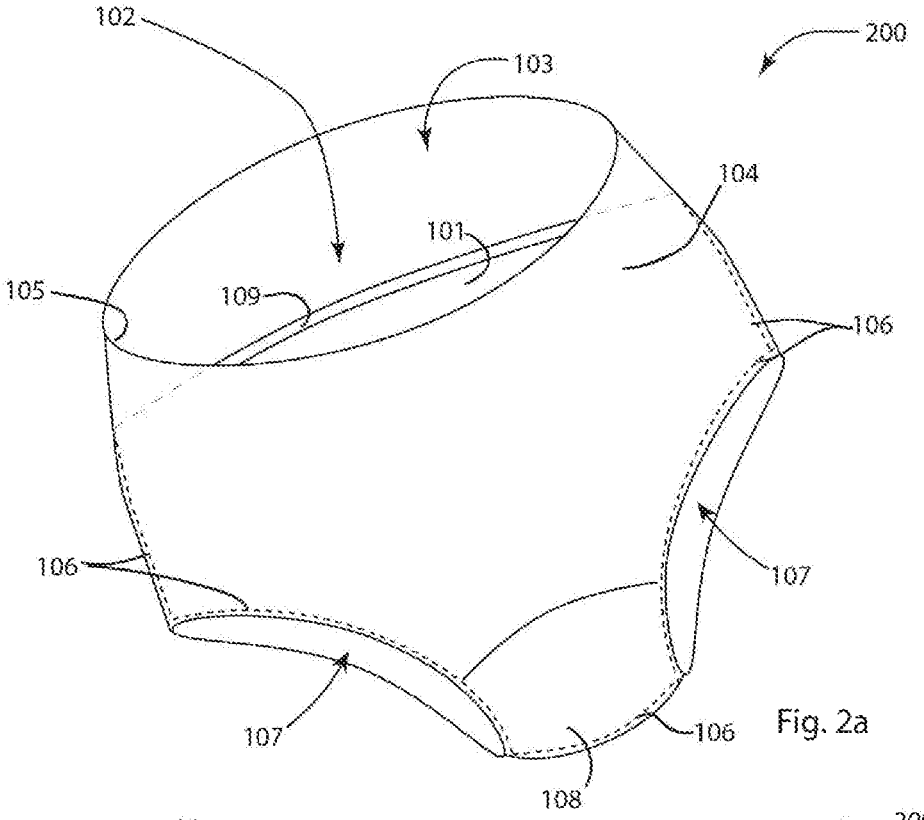
FIG. 2*a*. Perspective view of a second embodiment of the innovative undergarment.
Figure 2B:
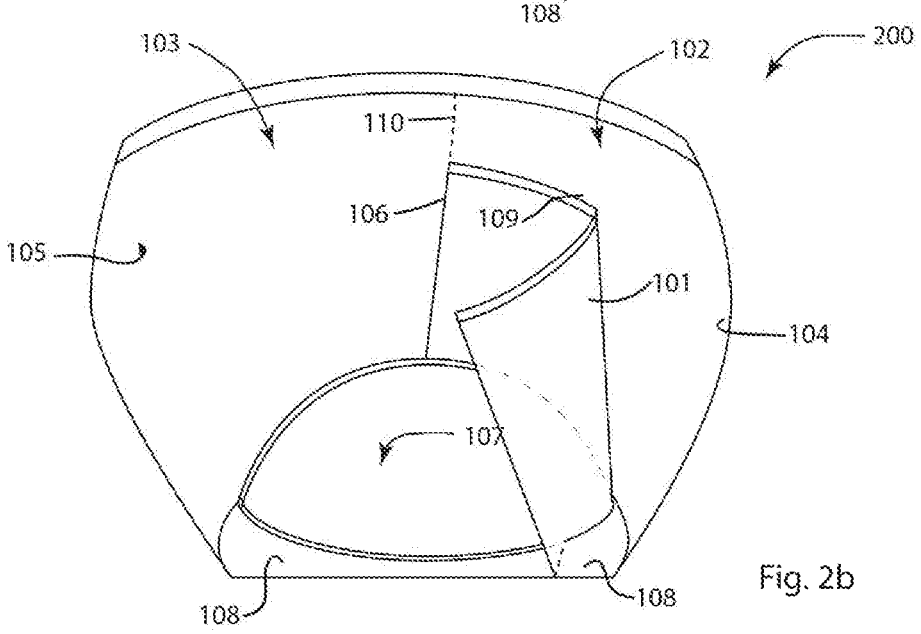
FIG. 2*b*. Side sectional view of a second embodiment of the innovative undergarment.

A second embodiment 200 of the innovative undergarment is shown in FIGS. 2*a* and 2*b*, where partition 101 is stitched to the body of the undergarment along seam 110 to the rim of leg opening 107, and along said rim, as indicated by following stitching 106. As is evident in FIGS. 2*a* and 2*b*, stitching 106 extends further along the rim of leg opening 107 than the first embodiment featured in FIGS. 1*a* and 1*b*, and then crosses crotch panel 108 further back from front panel 104 to join the second half of the innovative undergarment 100 (not shown). In the present embodiment of FIGS. 2*a-b*, partition 101 and front panel 104 are substantially not joined at the bottom of anterior compartment 102, leaving a region of crotch panel 108 to form a floor of compartment 102, as seen in FIG. 2*b*. In this embodiment, among other aspects, extra space is available to accommodate excess belly overhang of the wearer, where extra material may be available to for front panel 104 to stretch over the exterior of the belly overhang. Anterior compartment 102 thereby forms a pouch for the belly overhang.

Figure 3A:
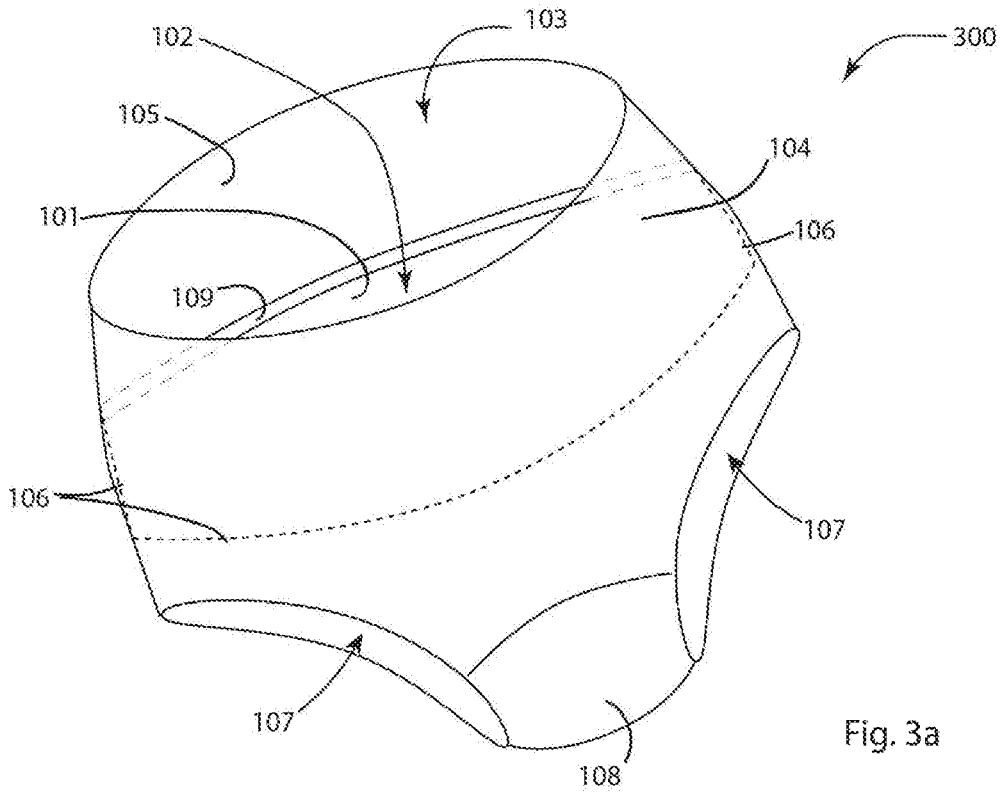
FIG. 3*a*. Perspective view of a third embodiment of the innovative undergarment.
Figure 3B:
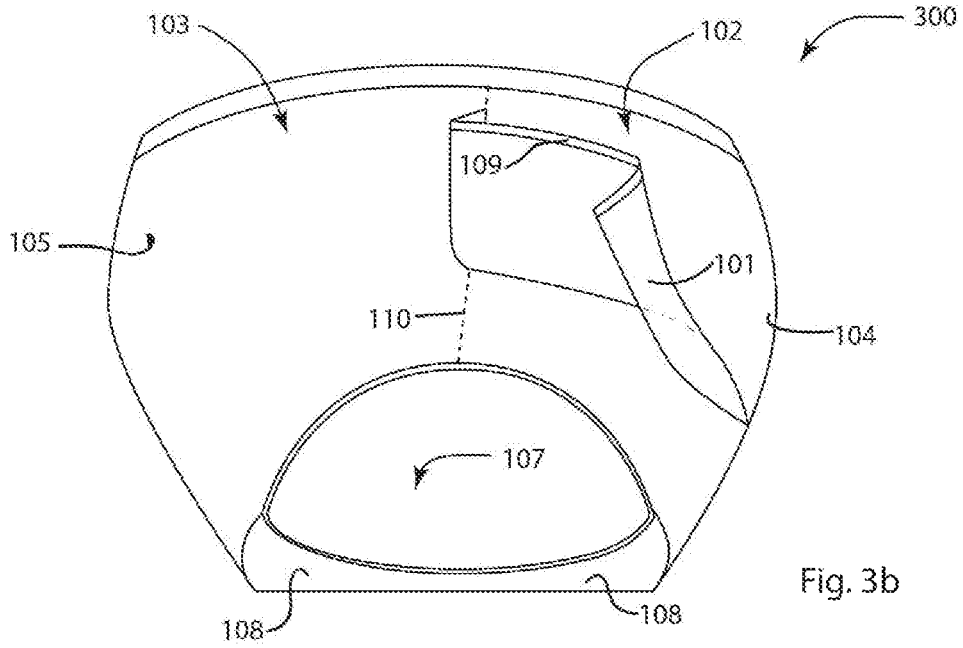
FIG. 3*b*. Side sectional view of a third embodiment of the innovative undergarment.

In a third embodiment, shown as undergarment 300 in FIGS. 3*a* and 3*b*, anterior compartment 102 is abbreviated lengthwise, where bottom of panel 101 may be stitched along front panel 104 further up from crotch panel 108 towards the top of front panel 104, as seen in FIG. 3*a* by following stitching 106 along front panel 104, and as shown in the sectional view of FIG. 3*b*. In this way, a smaller belly overhang may be accommodated without unduly forcing the undergarment to ride lower down the wearer's torso.

Figure 4A:
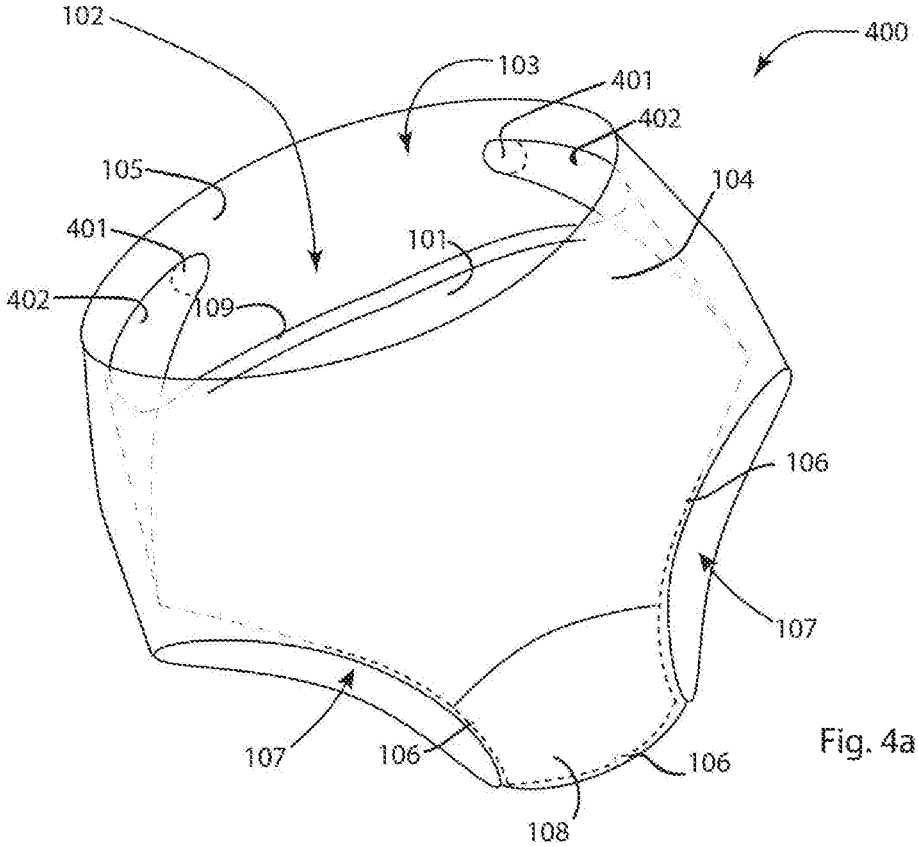
FIG. 4*a*. Perspective view of a fourth embodiment of the innovative undergarment.
Figure 4B:
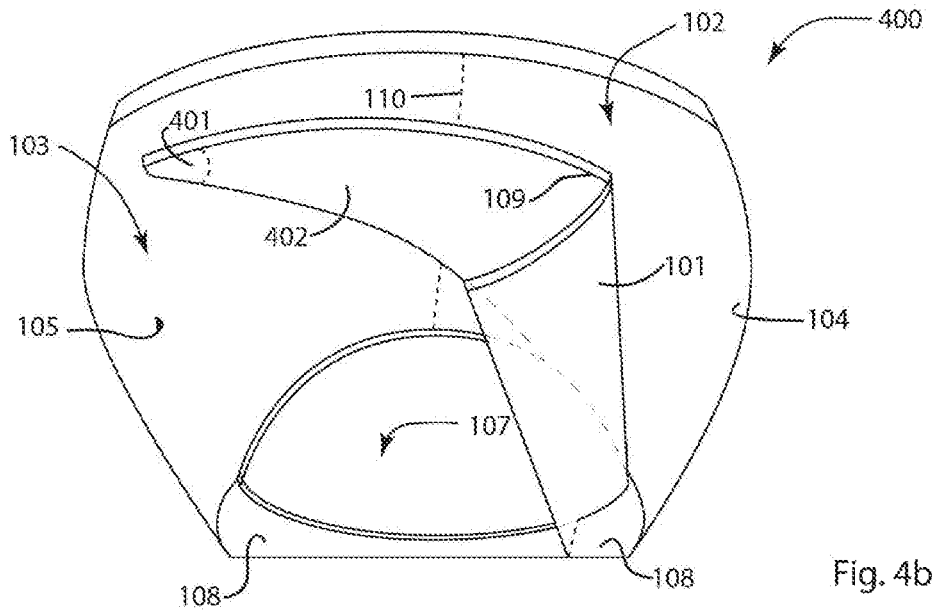
FIG. 4*b*. Side sectional view of a fourth embodiment of the innovative undergarment.

A departure from the general construction of the preceding embodiments, embodiment 400 shown in FIGS. 4*a* and 4*b* illustrate rear panel attachment or anchor joints 401 for partition 101, which extends along rear panel 105 by tapered extensions 402, as shown in FIG. 4*a*, to anchor joints 401 on both left and right sides of undergarment 400. Tapered extensions 402 are shown having a widening taper extending from joints 401 to contiguously merge with front panel 101, where the combination of extensions 401 and partition 101 may be considered as one integral partition piece, as illustrated by the hidden lines in FIG. 4*a*, and more clearly in the sectional side view of FIG. 4*b*. The bottom of tapered extensions 402 may coincide with and be integrally stitched along a portion of rims of leg holes 107, as can be seen by following stitching 106 in FIG. 4*a*, and by the hidden lines in FIG. 4*b*. In the present embodiment, front panel 101 is stitched along crotch panel 108 further away from front panel 104 as shown in FIGS. 2*a-b*, again forming a wider anterior compartment as a pouch for accommodating a large belly overhang In the present embodiment, greater physical support may be achieved by anchoring partition 101 (integral with extensions 401) for the wearer, by having the weight of the belly overhang distributed to the rear of the undergarment, and by providing extra material for the front panel 101 if necessary. In addition, front panel 101 is free to droop more easily and follow the natural contours of the wearer's abdomen without uncomfortably restricting the abdomen to conform to a particular shape. The configuration in the present embodiment is meant to be exemplary, and is by no means limiting. Other embodiments combining features of the present embodiment and those of the first embodiment illustrated in FIGS. 1*a-b* may be equally valid.

Figure 5:
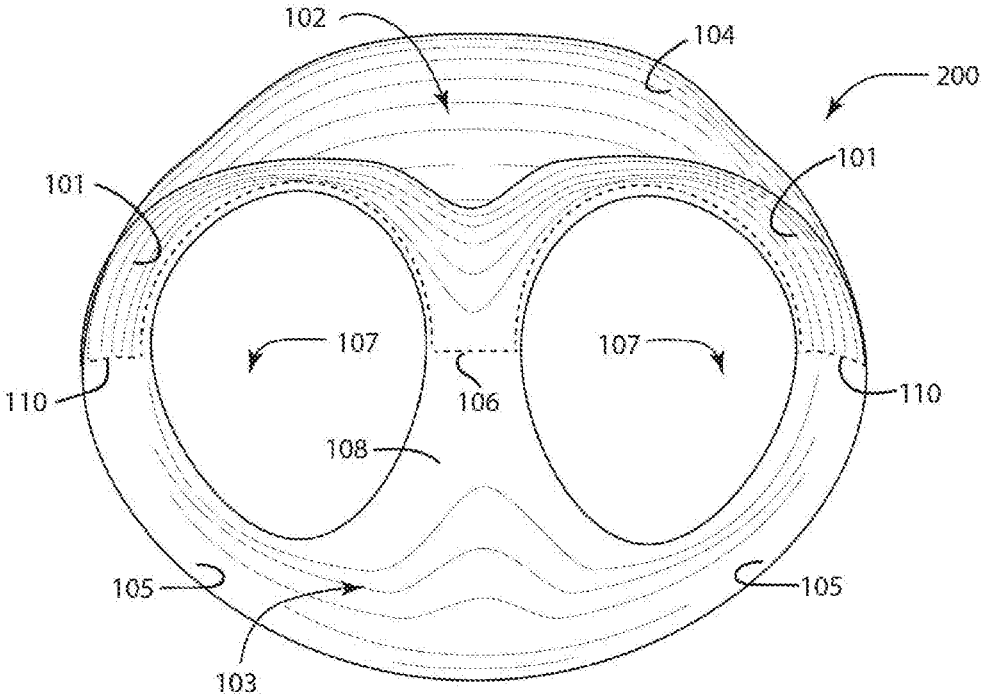
FIG. 5. Top view of a first embodiment of the innovative undergarment.
Figure 6:
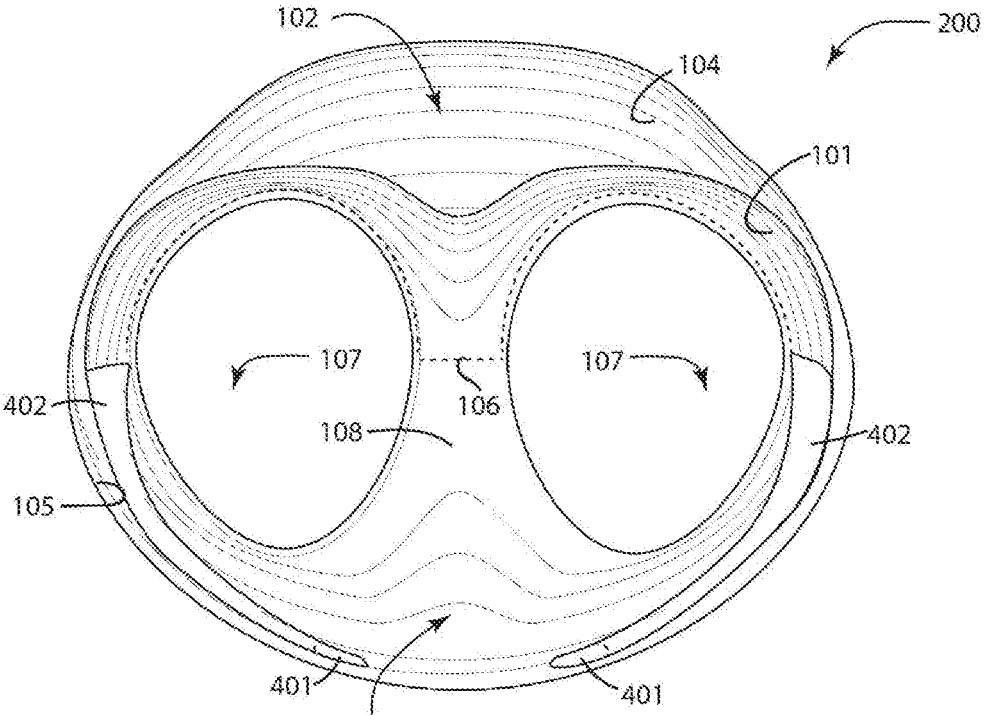
FIG. 6. Top view of a fourth embodiment of the innovative undergarment.

FIGS. 5 and 6 show a top view of two embodiments of the innovative undergarment. In FIG. 5, embodiment 100, illustrated in FIGS. 1*a-b*, is shown with partition 101 pulled away from front panel 104, exposing anterior compartment 102. The faint contour lines are drawn in as an aid to visualize the embodiments in three dimensions looking down from the top. Stitching 106 is also visible, and indicates how partition 101 may be attached to the undergarment body, as explained in detail above. In FIG. 5, partition 101 is shown terminating at and stitched along central seam 110. In equivalent embodiments, partition 101 may terminate along front panel 104 or rear panel 105, and be stitched thereto. In FIG. 6, the forth embodiment illustrated in FIGS. 4*a-b* is shown in top view. Extensions 402 are visible, extending from anchor joints 401 disposed along rear panel 105 to merge with partition 101, which is shown attached to the rims of leg openings 107 by stitching 106. Again, front panel 101 is folded back and away from front panel 104 to expose anterior compartment 102, which may form a pouch for the overhanging belly of the wearer.

Figure 7A:
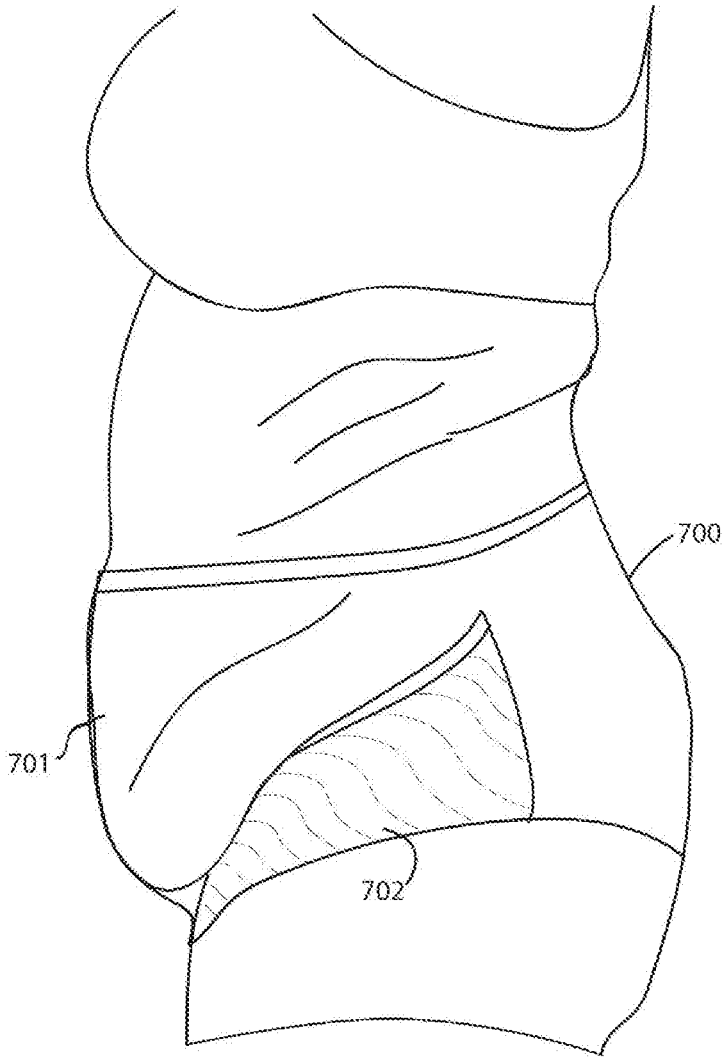
FIG. 7*a*. Depiction of the functionality of the innovative undergarment, as illustrated by a female wearer wearing the innovative undergarment. Side view.
Figure 7B:
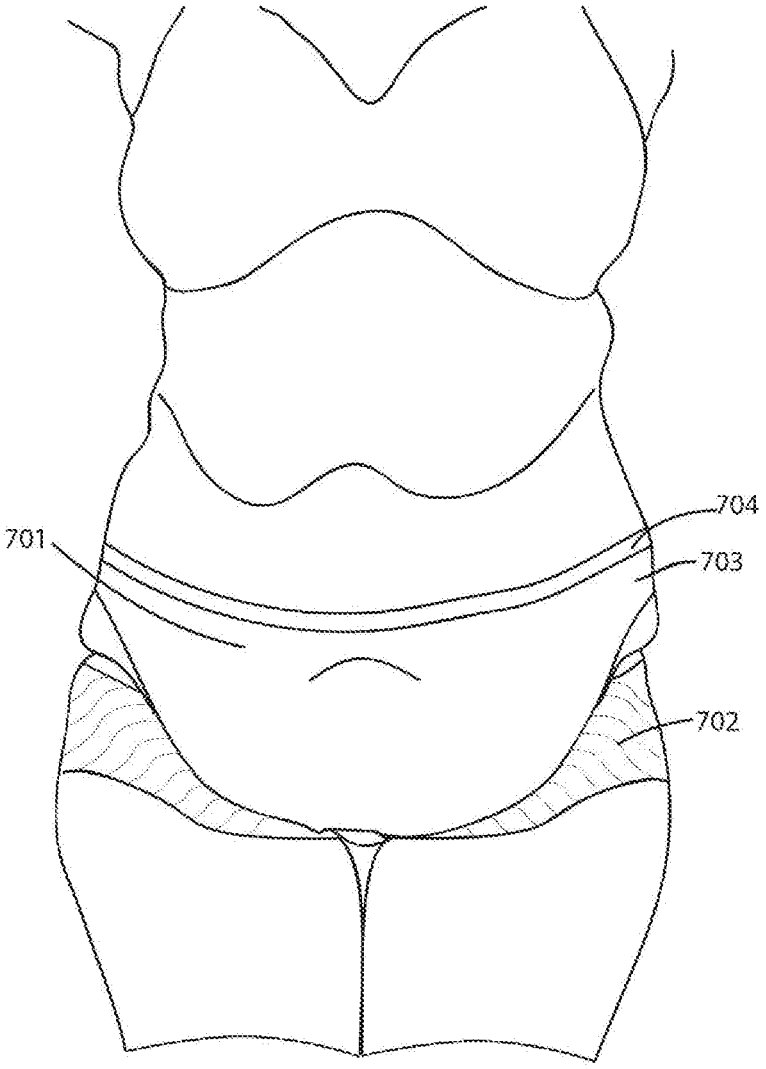
FIG. 7*b*. Depiction of the functionality of a first embodiment of the innovative undergarment, as illustrated by a female wearer wearing the innovative undergarment. Frontal view.

As examples of how the disclosed innovation is utilized, FIG. 7*a* depicts a representative side view of innovative undergarment 700, corresponding substantially to embodiment 1 of this description, being worn by a wearer having a belly overhang 701. For clarity, the outer fabric of the undergarment is not shown to reveal salient aspects of the lower abdomen of the wearer and partition 702. Partition 702 acts to protect the abdominal and groin regions from skin contact with belly overhang 701. FIG. 7*b* shows a representative frontal view of the same. Front panel 701 covers the front of belly overhang 701, and may be slipped over the belly by the wearer. Elastic band 704 may cause front panel 701 to hug the wearer's abdomen, while having the undergarment ride up to the waist for a comfortable fit. Partition 702 forms barrier to skin-to-skin contact between the underlying skin of the overhanging belly and the lower abdomen and groin regions of the wearer. An elastic band disposed along the top of partition 702 allows partition 701 to form fit the body of the wearer to ensure the function of the partition, and for comfort of the wearer. The space between the two panels forms a pouch to comfortably accommodate belly overhang 701.

Figure 8:
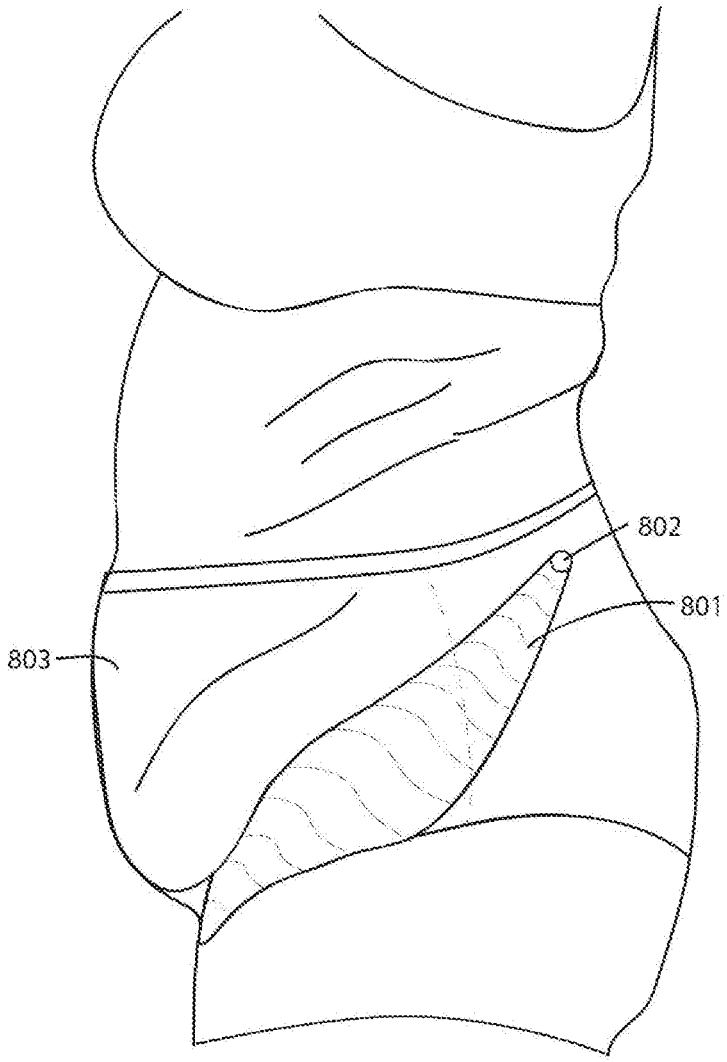
FIG. 8. Depiction of the functionality of a fourth embodiment of the innovative undergarment, having tapered extensions to the rear, as illustrated by a female wearer wearing the innovative undergarment. Side view.

Another example is shown in FIG. 8, where. The embodiment depicted in FIG. 8 substantially corresponds to the forth embodiment described above, and illustrated in FIGS. 4*a*-*b*. Tapered partition 801 is substantially the same as shown in FIGS. 4*a* and 4*b*, and is shown extending from anchor point 802, and widening towards the front, where it wraps under the belly overhang 803 to the opposite side, forming a symmetrical structure. In the side view of FIG. 8, the top of partition 801 naturally follows the contours of the wearer's abdomen, and permits a more comfortable fit for larger abdomens.

Figure 9:
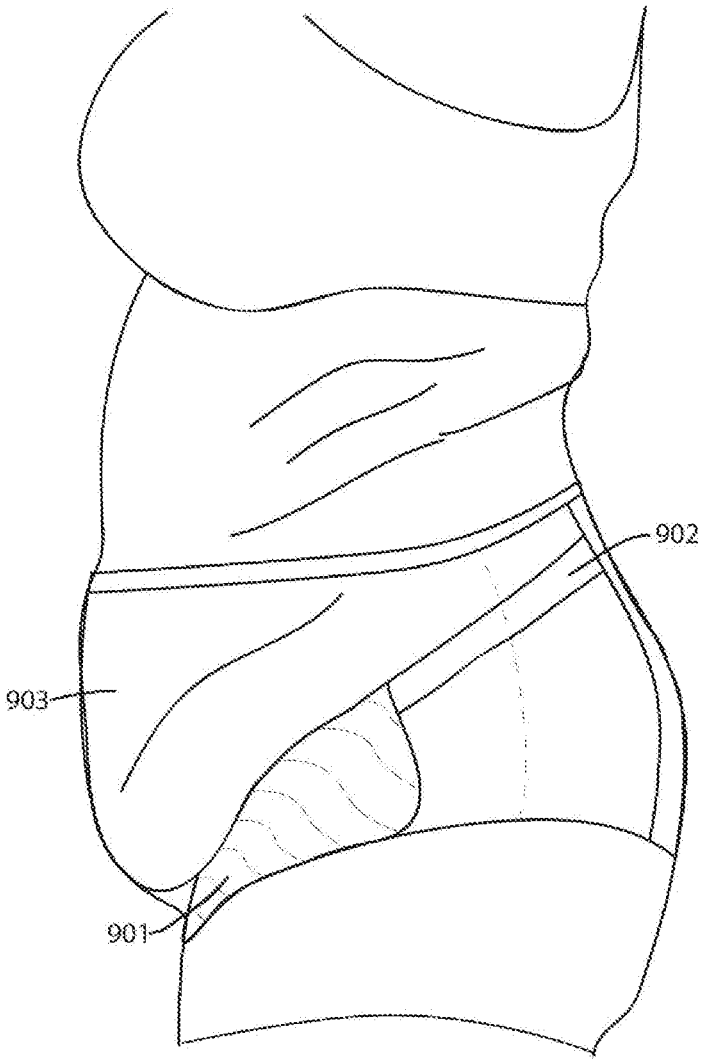
FIG. 9. Depiction of a fifth embodiment of the innovative undergarment, having straps connecting to the rear, as illustrated by a side view of a female wearer wearing the innovative undergarment.

A final embodiment is shown in FIG. 9, where a representative side view of the undergarment is shown as worn by a female wearer. In this embodiment, partition 901 is truncated near the midline of the undergarment body, and connected to the undergarment in the rear section by strap structures 902 (one shown in the side view).

In all foregoing embodiments, partition panel may be at least partially made from fabrics such as, but by no means limited to, nylon, cotton knit, cotton/polyester blend, cotton/spandex blends, cotton/Lycra blends, bamboo fiber, hemp fiber, bamboo/Lycra blends, hemp/Lycra blends, bamboo fiber/spandex blends, hemp fiber/spandex blends, microfiber and microfiber blends, and combinations thereof. Connection of both front panels and partition to the crotch can be in the front curve of crotch (same as front attachments of other commercial panties).

The embodiments described herein constitute several examples of the innovative undergarment, and are by no means to be construed as limiting the innovation to these examples. Skilled practitioners of the art will recognize that the innovation may be manifest in a multitude of equivalent variations, and when practiced do not depart from the scope and spirit of the innovation.

The invention claimed is:

1. An undergarment adapted to prevent skin-to-skin contact between the skin of a wearer's overhanging abdomen and the skin of the underlying lower torso of the wearer, comprising:

a) an undergarment constructed to fit around the lower torso of a wearer, said lower torso having an anterior portion and a posterior portion, wherein the undergarment comprises a front panel and a rear panel for covering respectively the anterior and posterior portions of the lower torso of the wearer, the front panel and the rear panel being joined together forming a midline seam of the undergarment, substantially coinciding with the left and right hip regions of the wearer's lower torso, wherein a contiguous fabric shell is formed enclosing an interior space, said interior space via having a waist opening and two leg openings, a crotch panel disposed between the two leg openings and extending between the front panel and the rear panel and being contiguous therewith, said undergarment having a left half and a right half; and b) a partition panel comprising a fabric panel having a top edge, a bottom edge and two side edges, disposed within the interior space and extending between the left and right halves of the undergarment and affixed thereto, the side edges of the partition panel are affixed to the undergarment substantially at the left and right hip regions of the lower torso, and wherein the bottom edge of the partition panel straddles the crotch panel and is affixed thereto, wherein the interior space of the undergarment is divided into an anterior compartment and a posterior compartment, said anterior compartment forming a pouch adapted to receive the overhanging abdomen of the wearer.

2. The undergarment of claim 1, wherein the top edge and the two side edges of the partition panel form tapered lateral extensions of the partition panel and extend laterally into the posterior portion of the undergarment, each tapered extension being affixed at an attachment point disposed on the rear panel of the undergarment.

3. The undergarment of claim 1, wherein each side edge of the partition panel is joined to a first end of a strap, said strap also having a second end, each strap extending from each side edge of the partition panel to the rear panel of the undergarment, and wherein the second end of each strap is affixed to an attachment point disposed on the rear panel of the undergarment.

4. The undergarment of claim 3, wherein the strap comprises an elastic material.

5. The undergarment of claim 1, wherein the bottom edge of the partition panel is affixed to the front panel of the undergarment between the crotch panel and the waist opening.

6. The undergarment of claim 1, wherein the partition panel further comprises an elastic band disposed along the top edge.

7. The undergarment of claim 1, wherein the partition comprises an elastic fabric.

8. An undergarment adapted to prevent skin-to-skin contact between skin of a wearer's overhanging abdomen and skin of the underlying lower torso, comprising:

a) an undergarment constructed to fit around the lower torso of a wearer, said lower torso having an anterior region, a posterior region, a left hip region and a right hip region, wherein the undergarment comprises a front panel and a rear panel, joined at a midline seam, for covering respectively the anterior and posterior regions of the lower torso of the wearer, the front panel and the rear panel being joined together along the midline of the undergarment, said midline seam substantially coinciding with the left and right hip regions of the lower torso, forming a contiguous fabric shell enclosing an interior space, said interior space having a waist opening and two leg openings, a crotch panel disposed between the two leg openings and extending between the front panel and the rear panel and being contiguous therewith, said undergarment having a left half and a right half; and b) a partition panel comprising a fabric panel having a top edge, a bottom edge and two side edges, disposed within the interior space of the undergarment and extending between the left and right halves of the undergarment and affixed thereto, and wherein the bottom edge of the partition panel straddles the crotch panel and is affixed thereto, wherein the interior space of the undergarment is divided into an anterior compartment and a posterior compartment, wherein the anterior compartment is adapted to receive the overhanging abdomen of the wearer.

9. The undergarment of claim 8, wherein at least a portion of the partition panel comprises an elastic material.

* * * * *